United States Patent [19]

Proto

[11] Patent Number: 4,668,197

[45] Date of Patent: May 26, 1987

[54] RETRACTABLE AUXILIARY AND EMERGENCY PROPULSION DEVICE FOR SMALL CRAFT

[76] Inventor: Salvatore Proto, Via Foschea, 11, 88034 Nicotera (CZ), Italy

[21] Appl. No.: 689,893

[22] Filed: Jan. 9, 1985

[51] Int. Cl.[4] ..... B63H 25/46

[52] U.S. Cl. ..... 440/54; 440/3

[58] Field of Search ..... 440/3, 5, 6, 54, 61

[56] References Cited

U.S. PATENT DOCUMENTS

| | | | |
|---|---|---|---|
| 578,879 | 3/1897 | Johannsen | 440/54 |
| 2,885,990 | 5/1959 | Hawthorne | 440/54 |
| 3,076,428 | 2/1963 | Shipley | 440/54 |
| 3,548,428 | 12/1970 | Eades | 440/54 |
| 3,685,481 | 8/1972 | Mansell | 440/54 |
| 4,075,971 | 2/1978 | Reginensi | 440/54 |
| 4,348,977 | 9/1982 | Okajima | 440/54 |
| 4,412,500 | 11/1983 | Krautkremer | 440/5 |

*Primary Examiner*—Joseph F. Peters, Jr.
*Assistant Examiner*—L. T. Bartz
*Attorney, Agent, or Firm*—Beveridge, DeGrandi & Weilacher

[57] ABSTRACT

Retractable auxiliary and emergency propulsion device for small craft comprising a hydraulic motor with its own propellor, powered by a hydraulic pump applied either to a motor installed on the craft just for this purpose and of considerably reduced power compared to the principle motor or to other motors already on the boat for other purposes, such as, for generators, refrigerators, compressors and the like the hydraulic motor sliding on inclined guides placed in the stern of the craft so as to be dropped into the sea when necessary, or raised up and placed in a suitable storage space in the boat.

7 Claims, 6 Drawing Figures

RETRACTABLE AUXILIARY AND EMERGENCY PROPULSION DEVICE FOR SMALL CRAFT

BACKGROUND OF THE INVENTION

The invention concerns a retractable auxiliary and emergency propulsion device for small craft. Preferably, the propulsion device is characterized by hydraulic transmission of motion.

As is well known, in the construction of boats up to 15 to 20 meters in length, even when the propulsive power required may be supplied by a single motor, it is preferable to use two completely autonomous units in order to provide greater security.

Of course, this solution leads to increased cost, greater weight and higher fuel consumption. In fact, a motor of power P consumes less than two motors of power P/2 for obvious mechanical and thermodynamic reasons.

In effect however, such a system provides only relative security. Whenever a problem occurs which leads to the use of one motor only, conditions are such that continuing navigation is difficult. This is particularly true for small displacement craft with lesser inertia. This is due in particular to the following factors:

(a) the propulsive force does not act along the barycenter of the boat and thus tends to rotate the boat, a tendency which can never be totally overcome with the steering apparatus;

(b) for the above reason and due to the reduced effectiveness of the steering organs in compensating for the rotating tendency, the boat cannot maintain a precise course, a problem which becomes even more severe under adverse weather conditions;

(c) the still operational motor may be run under overload conditions and so must be used at considerably reduced power to prevent this; this is even more indispensable for preventing cavitation of the propeller (with consequent loss of thrust) when it is overloaded.

All of the above factors lead to a very low average velocity.

SUMMARY OF THE INVENTION

The aim of the invention is to provide a new auxiliary and emergency propulsion device for boats, which device is reliable and economical and may be used when the principle propulsion motor becomes inoperative.

This objective is achieved by the present invention comprising a hydraulic motor with its own propulsion propeller, operated by a hydraulic pump applied either to a motor installed on the boat exclusively for this purpose and of considerably reduced power with respect to the principal motor, or the other motors already on board which normally perform other functions such as generators, refrigerators, compressors and the like. The hydraulic motor slides on inclined guides placed in the stern of the boat so that it may be dropped into the sea when necessary or raised up onto the boat.

BRIEF DESCRIPTION OF THE DRAWINGS

A preferred embodimenft of the invention is shown in the attached figures. In the drawings.

DETAILED DESCRIPTION OF A PREFERRED EMBODIMENT

Figure 1:
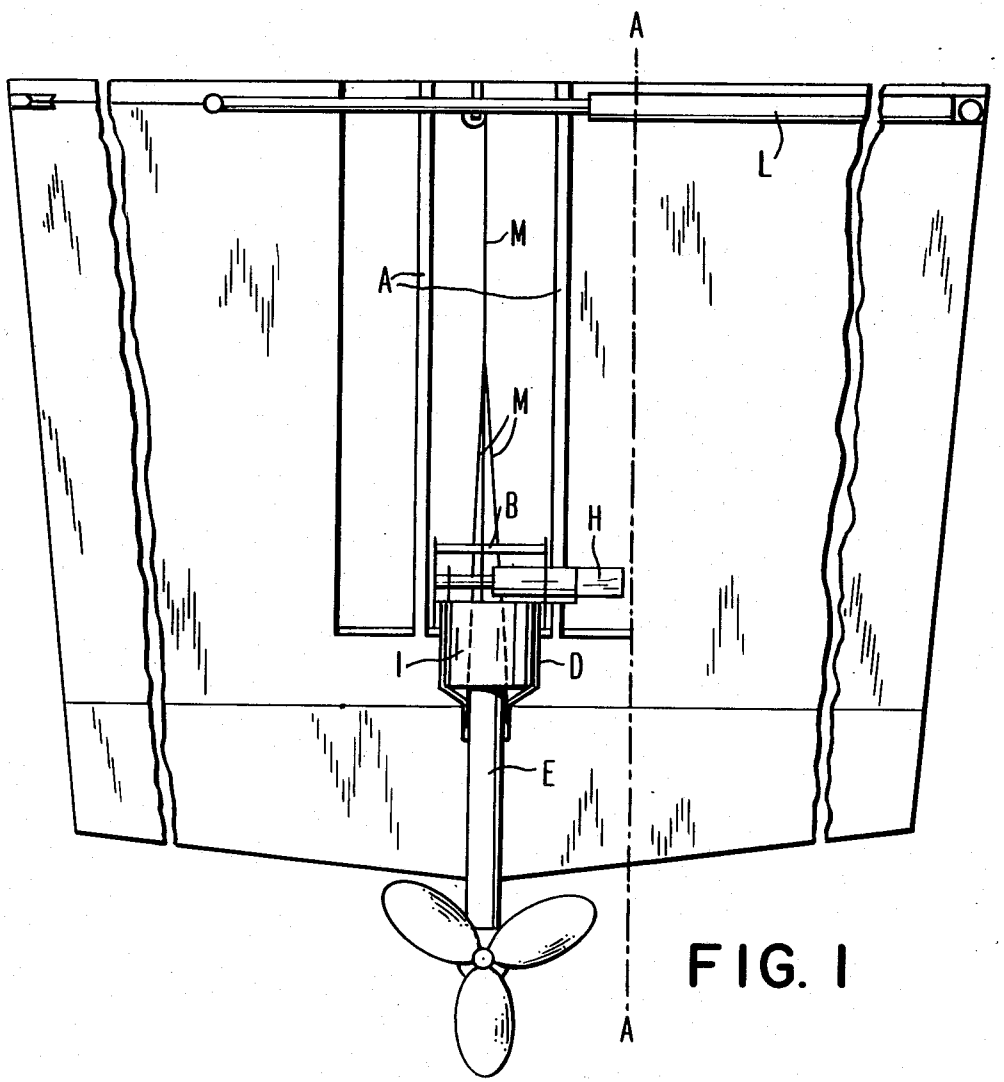
FIG. 1 is a rear view according to the B—B section of FIG. 2, wherein the device according to the present invention is installed on a boat.
Figure 2:
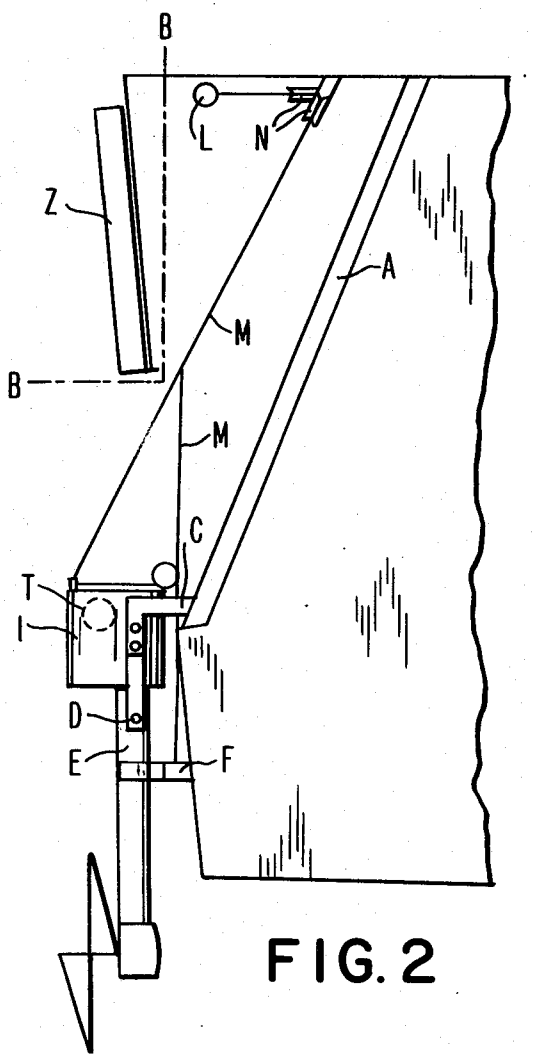
FIG. 2 is a side view of the device and boat depicted in FIG. 1 along the A—A section of FIG. 1.
Figure 3:
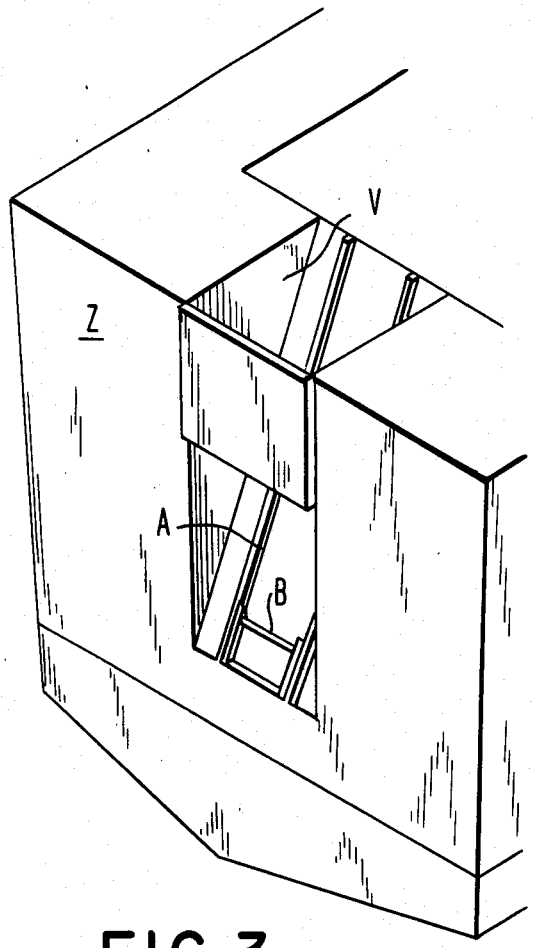
FIG. 3 is an axonometric view of the rear of the boat with the housing, the arms, the supports and the sleeves and propeller assembly removed.
Figure 4:
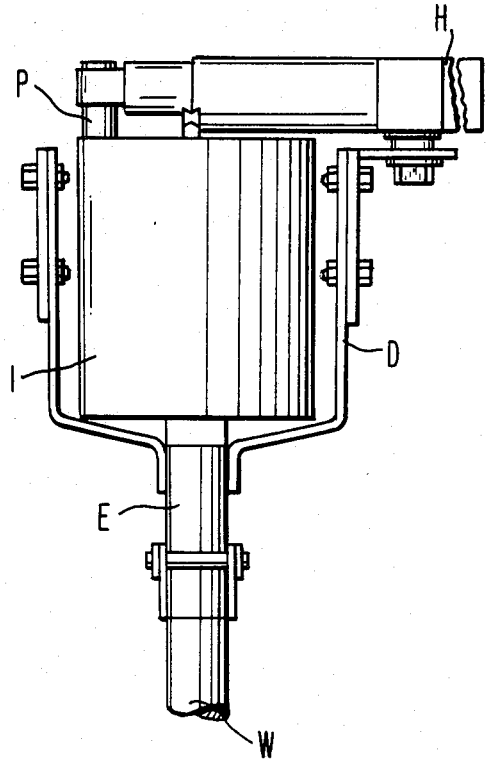
FIG. 4 is a detailed rear view of the support and operating structure for the hydraulic motor.
Figure 5:
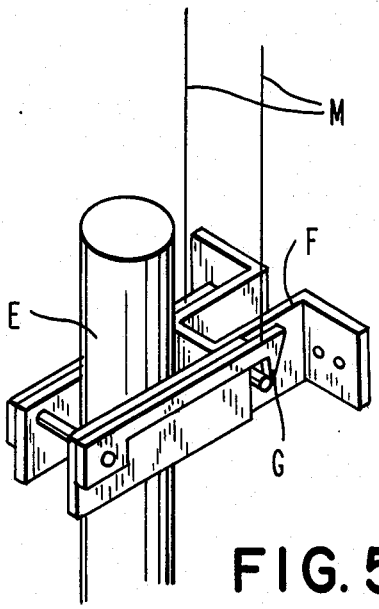
FIG. 5 is an axonometric view of the structure for connection to the stern of the craft.
Figure 6:
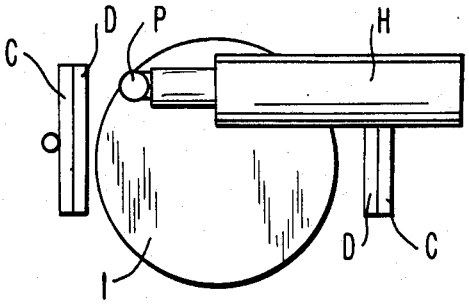
FIG. 6 is a downwardly looking view of the container and a hydraulic cylinder H.

Relating to the details of the Figures, V indicates the space for storing the device, with the two guides A in which slide B moves carrying, at the lower end thereof, the two articulated arms C. The guides A are movable and, according to the use, may be fixed from the vertical to the horizontal position. To arms C, support sleeve E is connected by means of supports D, the sleeve getting fixed, in the lower part thereof, to support F (applied to the boat) by means of hooks G thus determining the longitudinal as well as the transverse rigidity.

Support F also resists the thrust of the propeller.

In sleeve E, the whole system may rotate. The system consists of the sealed container for the hydraulic motor I and pump T, of the container of the transmission shaft W, of the reduction box with return and of the propeller.

Alternatively, the sleeve may be attached to the reservoir.

Hydraulic cyclinder H, bound by arm C and connected to container I at pivot pin P, rotates the system to perform the action of a rudder.

Obviously, as an alternative, rotation may be effected with any other currently used rudder system (double cable, single cable, chains, etc.).

Where the transmission returns, there is a hydraulic cylinder L connected by means of cable M and pulley N to container I. When the cable M is pulled it causes release of hooks G and rotation of the group on arms C. At this point the slide B begins to move along guides A up to the resting position thereof.

The reverse movement is effected by gravity, if the guides A are sufficiently steeply inclined. Otherwise, the reverse movement results with the assistance of suitably connected hydraulic cylinders or electromechanical apparatus.

The sliding up into the rest position may also be effected using electromechanical apparatus.

Of course, the sliding movement may also be effected manually or by a manually operated winch. The hatch Z closes the storage space V. The hatch may be moved into place manually or automatically with one of the systems described above.

The device according to the invention offers the following striking advantages:

(1) the propulsive thrust acts along the barycenter of the craft;

(2) the steering organs are free to steer the boat rather than compensate for rotational movement;

(3) even when the principle steering organs become inoperative, the boat continues to have complete maneuverability to hold its course;

(4) the hydrodynamic conditions of the hull are left unchanged;

(5) the device is economical since only one principle motor need be installed;

(6) the auxiliary motor, having lesser power than the principle one, may normally perform other functions on board;

(7) the device guarantees sustained autonomy and full reliability; in fact, the lower power of the motor, while leading to lower velocities, also guarantees much lower consumption;

(8) the device may be used instead of the principle motor for travelling for short distances or at low speeds;

(9) the device leaves the appearance of the boat unchanged.

Finally, in an alternative embodiment, the hydraulic motor and related hydraulic pump may be replaced by an electric motor placed in the reservoir container I.

I claim:

1. An independent, retractable auxiliary and/or emergency propulsion apparatus, having a hydraulic motor and a pump for use in small water craft having a compartment in the stern thereof, said auxiliary propulsion apparatus comprising:

a pair of guide members mounted to the stern and having a first end located in said compartment and a second end;

a slide movable on said guide members between said first and second ends;

a pair of arms pivotally connected to said slide and extending outwardly therefrom;

a housing carried by said arms, said housing containing said hydraulic motor;

a propeller assembly including a propeller;

a transmission shaft operatively connecting said propeller to said motor;

a sleeve covering said transmission shaft and supporting said propeller assembly;

support means, receiving said sleeve therethrough for positioning said sleeve along the craft whereby a portion of said sleeve and said propeller assembly are submerged, said propeller assembly and said portion of said sleeve being in a submerged position when said slide is at said second end of said guide members, said support means including locking means for releasably locking said sleeve in said position;

a first hydraulic cylinder, connected to said housing, for rotating said housing and said propeller assembly whereby said first cylinder and said housing and said propeller assembly provide rudder functions for the craft; and means, connected to said slide, for moving said slide on said guide members, said locking means being releasable by said moving means.

2. An auxiliary propulsion apparatus as claimed in claim 1, wherein said guides are orientable along a horizontal axis, a vertical axis, or any axis of inclination therebetween.

3. An auxiliary propulsion apparatus as claimed in claim 1, wherein said sleeve is connected to said housing.

4. An auxiliary propulsion apparatus as claimed in claim 1, wherein said guides are inclined whereby said slide is moved from said first end located in said compartment to said second end by gravity.

5. An auxiliary propulsion apparatus as claimed in claim 1, wherein said locking means comprises hooks.

6. An auxiliary propulsion apparatus as claimed in claim 1, wherein said means for moving said slide comprises a second cylinder and means for connecting said second cylinder to said housing, said second cylinder pivoting said housing with respect to said slide to release said locking means and permit said sleeve to move out of said position, said second cylinder moving said slide carrying said housing, said sleeve and said propeller assembly along said guides from said second end to said first end within said compartment.

7. An auxiliary propulsion apparatus as claimed in claim 10, wherein said means for connecting said second cylinder to said housing comprises a cable running over a pulley.

* * * * *